US006694770B2

(12) United States Patent
Winders et al.

(10) Patent No.: US 6,694,770 B2
(45) Date of Patent: Feb. 24, 2004

(54) FRENCH DOOR CHILLER COMPARTMENT FOR REFRIGERATORS

(75) Inventors: Dennis E. Winders, Cedar Rapids, IA (US); Eric S. Svenby, Sigourney, IA (US); Jonathan J. Tiemeier, Coralville, IA (US); David J. Olberding, Cedar Rapids, IA (US); Michael J. Eveland, Cedar Parks, IA (US); Todd E. Kniffen, Williamsburg, VA (US); Ravi Kumar Sawhney, Calabasas, CA (US); Timothy Mark Nugent, Venice, CA (US); John Frank Zinni, Capistrano Beach, CA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/195,648

(22) Filed: Jul. 15, 2002

(65) Prior Publication Data

US 2003/0024265 A1 Feb. 6, 2003

Related U.S. Application Data

(60) Provisional application No. 60/305,790, filed on Jul. 16, 2001.

(51) Int. Cl.[7] ..... F25D 11/00

(52) U.S. Cl. ..... 62/440; 62/377; 312/405.1

(58) Field of Search ..... 62/440, 377, 441; 312/404, 405.1, 321.5, 324, 326, 329; 49/73, 104, 109

(56) References Cited

U.S. PATENT DOCUMENTS

| | | | | | |
|---|---|---|---|---|---|
| 3,203,199 | A | * | 8/1965 | Stewart | 62/414 |
| 3,216,776 | A | | 11/1965 | Carbary | |
| 3,375,936 | A | | 4/1968 | Kessler | |
| 3,628,845 | A | * | 12/1971 | Grimm | 312/309 |
| 3,789,620 | A | * | 2/1974 | Benasutti et al. | 62/344 |
| 3,804,482 | A | | 4/1974 | Smith | |
| 4,186,978 | A | * | 2/1980 | Thomson | 312/321.5 |
| 4,361,368 | A | * | 11/1982 | Daniels | 312/138 R |
| 4,779,939 | A | * | 10/1988 | Stich | 312/405 |
| 4,798,425 | A | | 1/1989 | Armstrong et al. | |
| 5,048,724 | A | * | 9/1991 | Thomas | 222/95 |
| 5,100,213 | A | | 3/1992 | Vandarakis et al. | |
| 5,445,452 | A | | 8/1995 | Kauffman et al. | |
| 5,536,081 | A | * | 7/1996 | Pokhis | 312/321.5 |
| 5,685,624 | A | * | 11/1997 | Lee | 312/405.1 |
| 5,816,058 | A | * | 10/1998 | Lee et al. | 62/126 |
| 5,870,801 | A | * | 2/1999 | Kim | 16/382 |
| 5,945,146 | A | | 8/1999 | Twinam | |
| 6,019,447 | A | * | 2/2000 | Jackovin | 312/405 |
| 6,231,146 | B1 | * | 5/2001 | Dang | 312/405.1 |

FOREIGN PATENT DOCUMENTS

| | | | |
|---|---|---|---|
| GB | 959571 | | 6/1964 |
| GB | 2129037 | | 5/1984 |
| GB | 3242350 A | * | 5/1984 |
| JP | 03-175247 | | 7/1991 |
| JP | 10238943 A | * | 9/1998 |

* cited by examiner

*Primary Examiner*—William E. Tapolcai
*Assistant Examiner*—Mohammad M. Ali
(74) *Attorney, Agent, or Firm*—McKee, Voorhees & Sease, P.L.C.

(57) ABSTRACT

A chiller compartment is provided that secures to the inside of a refrigerator door. The chiller compartment includes a pair of French doors that are connected by a linkage that causes the doors to simultaneously open or close. The doors retract within the chiller compartment when opened, thereby protecting the doors should the refrigerator door be closed while the chiller compartment doors are left open. The chiller compartment also includes a tray of sufficient height to secure tall beverages or food items and prevent such items from toppling out of the chiller compartment while the refrigerator door is opened or closed.

14 Claims, 3 Drawing Sheets

FRENCH DOOR CHILLER COMPARTMENT FOR REFRIGERATORS

CROSS-REFERENCE TO RELATED APPLICATIONS

This application claims priority to the U.S. provisional patent application serial No. 60/305,790 entitled "French Door Chiller Compartment for Refrigerators" filed on Jul. 16, 2001.

BACKGROUND OF THE INVENTION

The present invention relates generally to refrigerators and, more particularly, to a French door chiller compartment for refrigerators, wherein the chiller compartment is maintained at a temperature slightly lower than the rest of the interior of the refrigerator.

A refrigerator is often provided with a chiller compartment to keep beverages or food items at a slightly lower temperature than the rest of the interior. Quick and easy access to the items stored in the chiller compartment is desirable and therefore it would be preferable to mount the chiller compartment in the refrigerator door.

One disadvantage of current chiller compartments is that the doors, which separate the chiller compartment from the rest of the interior of the refrigerator, function independently of each other, requiring the user to employ both hands when gaining access to the chiller compartment to load or retrieve items. For example, U.S. Pat. No. 4,361,368 to Daniels discloses a refrigerator storage compartment that utilizes two sliding doors that work independently of each other. To gain access to the storage compartment, the user must slide each door individually. Further, sliding one of the doors only permits access to half of the storage compartment at one time. Similarly, U.S. Pat. No. 3,804,482 to Smith discloses a wine chiller with two doors that swing away from the cabinet. These cabinet doors function independently of each other, and the user would have to employ both hands to simultaneously open the doors in gaining quick access to all of the contents inside.

Another disadvantage of many chiller compartments is that the door or doors protrude from the chiller compartment while in the open position and may be damaged should the refrigerator door be closed while the chiller compartment door or doors are left open. U.S. Pat. No. 3,203,199 to Stewart discloses a compartment located in the bottom of the interior of the refrigerator with two doors that swing outward. While in the open position, the compartment doors protrude significantly from the interior of the refrigerator and may be damaged should the refrigerator door be shut while these compartment doors are in the open position. It is therefore desirable to have a chiller compartment with doors that will not break should the refrigerator door be closed while the compartment doors are open.

Additionally, the door or doors of many chiller compartments may not stay open on their own. These doors may require additional stops or latching devices to stay open, again requiring the user to employ both hands when gaining access to the chiller compartment to load or retrieve items. U.S. Pat. No. 5,100,213 to Vandarakis et al. discloses a refrigerator door chiller compartment with a door that slides open vertically. To keep the door open on its own, the user must slide the door to the fully open position, where a stop or latching device is used to keep the door open. However, the door will close if not manually restrained by the user. It is therefore desirable to have a chiller compartment which includes doors that will remain in position without additional securing devices.

Accordingly, a general feature of the present invention is the provision of a chiller compartment which overcomes the problems found in the prior art.

A further feature of the present invention is the provision of a chiller compartment for refrigerators including doors that allow for one-hand operation.

Another feature of the present invention is the provision of a chiller compartment for refrigerators with doors that will not become damaged if left in the open position while the refrigerator door is closed.

A still further feature of the present invention is the provision of a chiller compartment for refrigerators with doors that remain in the fully open, fully closed, or any intermediate position on their own without the need for additional stops or latching devices.

Another feature of the present invention is the provision of a chiller compartment for refrigerators with doors that open to provide full accessibility to the interior of the chiller compartment.

A further feature of the present invention is the provision of a chiller compartment for refrigerators capable of holding and retaining tall containers during normal opening and closing of the refrigerator door.

These, as well as other features and advantages of the present invention will become apparent from the following specification and claims.

SUMMARY OF THE INVENTION

The present invention is directed towards a refrigerator chiller compartment which generally includes a cabinet housing that secures to the inside of a refrigerator door. The cabinet housing has an open front side that allows for full access into the interior of the cabinet housing.

Two doors secured to the cabinet housing are connected to each other by a linkage that allows for simultaneous operation. By grasping and moving either door with one hand, the linkage engages to simultaneously move the other door. An internal tray is also provided. The internal tray has sides sufficiently tall to prevent tall beverages, such as 2-liter bottles or food items rolling or from toppling out should the refrigerator door be quickly opened or closed. Additionally, a top cover to the housing cabinet is provided for enclosing and protecting the door linkage.

DETAILED DESCRIPTION OF THE INVENTION

The present invention will be described as it applies to its preferred embodiment. It is not intended that the present invention be limited to the preferred embodiment. It is intended that the invention cover all modifications and alternatives that may be included within the spirit and scope of the invention.

Figure 1:
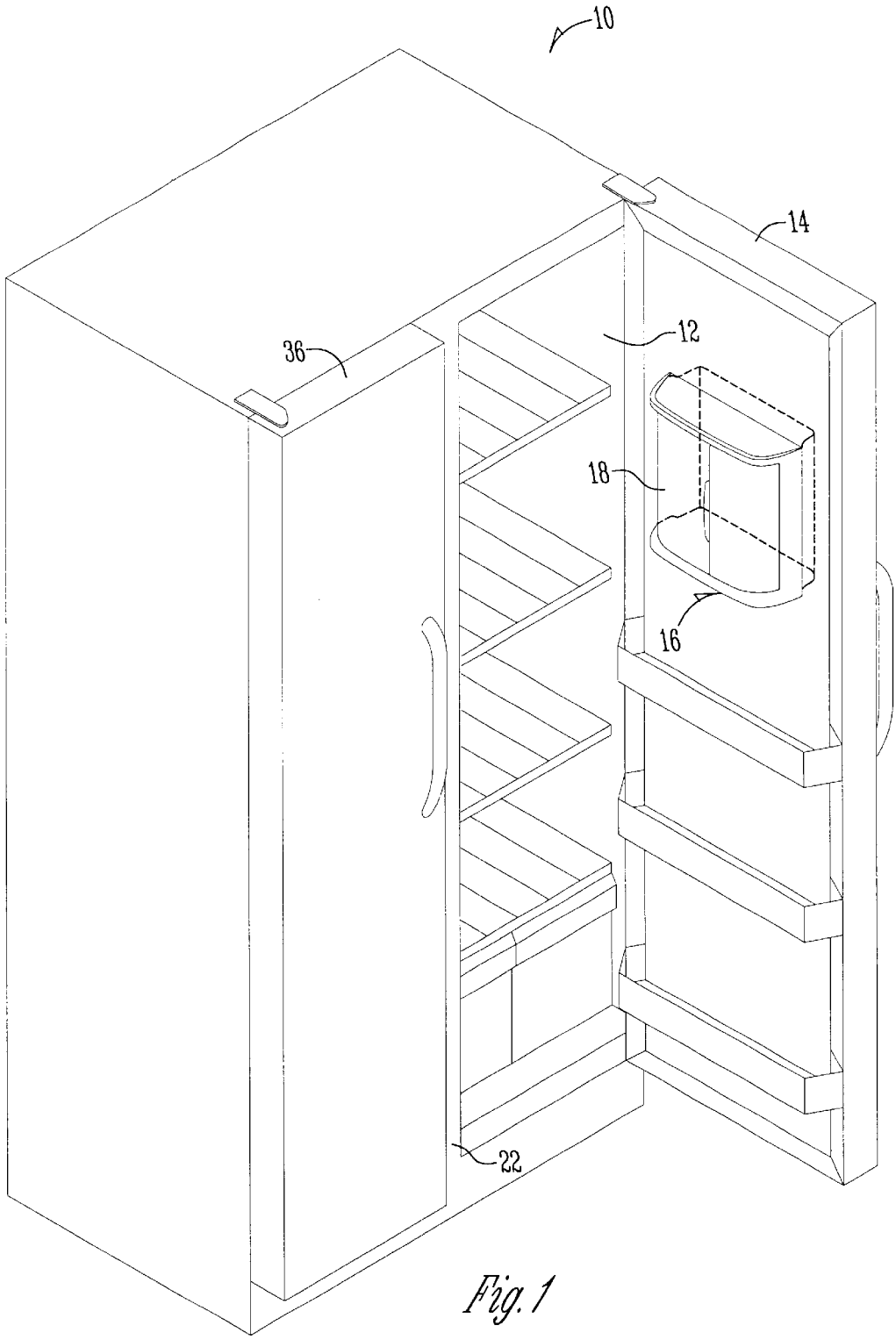
FIG. 1 is a perspective view of an exemplary side-by-side refrigerator with the door open to show a possible mounting arrangement for the chiller compartment of the present invention.

With reference to FIG. 1, a refrigerator 10 is depicted and is of the style generally referred to as a side-by-side refrigerator, although the present invention also can be used with other types of refrigerators or freezers. The refrigerator 10 has an interior 12 accessed by a refrigerator door 14, which is illustrated in the open position in FIG. 1. The refrigerator 10 is provided with a chiller compartment 16 secured to the door 14. Chiller compartment 16 of refrigerator 10 is provided with chiller compartment doors 18.

In a conventional manner, cold air from the evaporator (not shown) is directed through a duct (not shown) in the refrigerator wall or mullion 22 that separates the refrigerator from the freezer 36. The air is directed from an inlet port (not shown) in the mullion 22 to the chiller compartment 16. This cold air maintains the chiller compartment 16 at a temperature slightly below the rest of the interior 12 of the refrigerator 10. Preferably, the temperature of the chiller compartment 16 is adjustable through conventional means.

Figure 2:
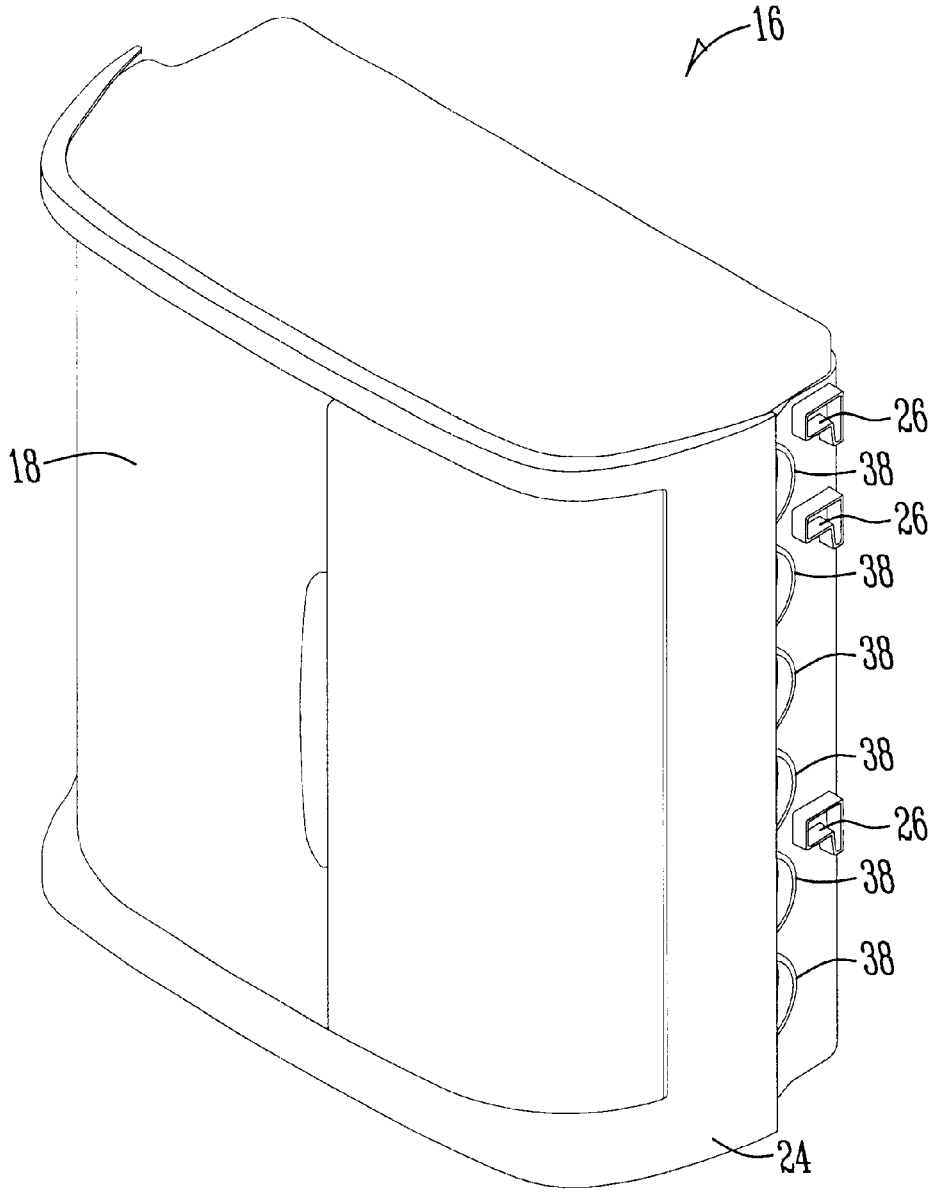
FIG. 2 is a perspective view of the French door chiller compartment of the present invention with the doors in the closed position.

With reference to FIG. 2, the chiller compartment 16 is shown to generally comprise a cabinet housing 24 with doors 18, shown in the closed position. Ports 38 in the cabinet housing 24 are adapted to allow for cold air from the inlet port (not shown) in the mullion 22 to enter the chiller compartment 16. Including a plurality of ports 38 allows the chiller compartment 16 to be placed in a variety of positions in the refrigerator door 14 and yet be connected to the inlet port which may be in a fixed position. The cabinet housing 24 also includes one or more brackets 26 to quickly and easily secure the chiller compartment 16 to corresponding receiving brackets in the refrigerator door 14. Each bracket 26 is a protrusion from the side of the cabinet housing 24 and may include any type of hook or latch.

Figure 3:
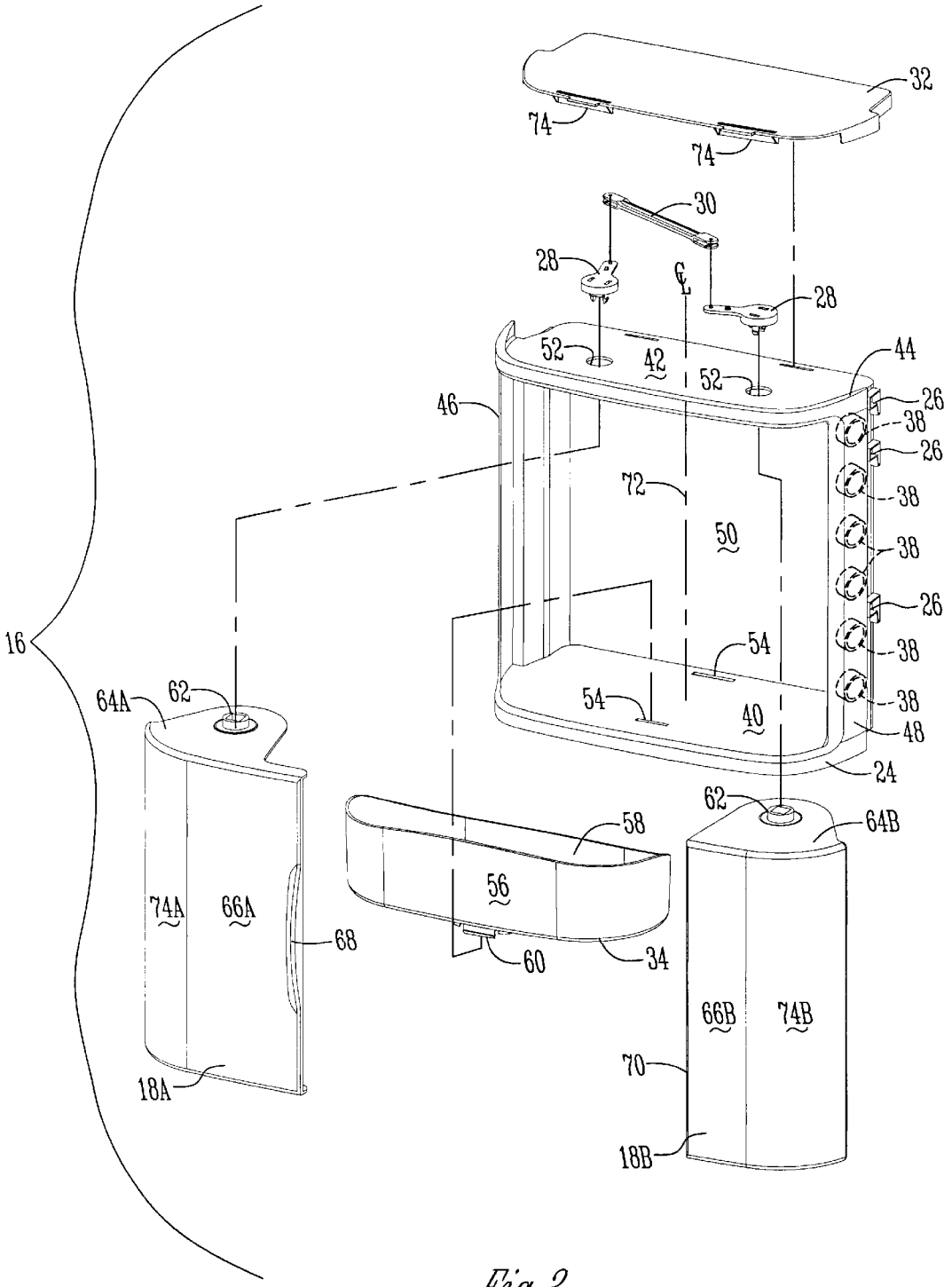
FIG. 3 is an exploded view of the French door chiller compartment.

With reference to FIG. 3, the chiller compartment 16 is shown to generally comprise a pair of vertically upstanding doors 18A, 18B, a chiller compartment cabinet housing 24, a tray 34, a chiller door linkage 28, 30 and a chiller cabinet housing top cover 32. The chiller compartment 16 may be of any desired height or width and the refrigerator 10 may include a variety of different sized chiller compartments 16. Doors 18A, 18B may be generally referred to as French doors.

The cabinet housing 24 has a floor 40, a top 42 including a front flange 44, two vertically upstanding side walls 46, 48, and a back wall 50. The top 42 is provided with suitable openings 52, and the cabinet housing floor may be provided with openings 54 as will be hereinafter described in greater detail. The rear portion of side walls 46, 48 of cabinet housing 24 may be provided with one or more brackets 26 to secure the chiller compartment 16 to the refrigerator door 14. As is known in the art, all of the foregoing components of the chiller compartment 16 may be formed of any suitable material having the requisite strength and temperature resistance characteristics to be used in a refrigerator in a manner hereinafter to be described.

Chiller tray 34 has a vertically upstanding front wall 56 and a rear wall 58. The front wall 56 has a height sufficient to retain the intended contents of the chiller compartment 16, such as a plurality of bottles and other types of containers, within the chiller compartment 16 as the refrigerator door 14 is opened and closed, even if doors 18A, 18B have been left open. The bottom of chiller tray 34 is provided with support rings (not shown) which cooperate with doors 18A, 18B as will hereinafter be described. The front and rear walls 56, 58 of chiller tray 34 are provided with one or more downwardly depending hooks or tabs 60 which are matingly received in the openings 54 in the floor 40 of the cabinet housing 24. In this manner, the chiller tray 34 hooks and snaps into the cabinet housing floor 40. Preferably, when the chiller tray 34 is snapped into the cabinet housing floor 40, the bottom surface of chiller tray 34 is spaced from the cabinet housing floor 40, as will hereinafter be described in further detail.

French doors 18A, 18B are each provided with a boss member 62 disposed on the top of upper flange members 64A, 64B of doors 18A, 18B. Similarly, each door 18A, 18B is provided with a lower flange member (not shown) with the front wall surfaces 66A, 66B of doors 18A, 18B extending between the upper and lower flange members of the doors 18A, 18B.

Boss members 62 of doors 18A, 18B are received within openings 52 in the top 42 of the cabinet housing 24. The lower flange members of doors 18A, 18B are secured in place by chiller tray 34, and the doors pivot about the support rings (not shown) disposed on the bottom of the chiller tray 34. The rings also act as supports for the chiller tray 34.

After boss members 62 of doors 18A, 18B are inserted through openings 52, the door linkage 28, 30 is assembled. Linkage members 28 are snapped into boss members 62 through openings 52, and are connected by a center link 30, the ends of which snap into linkage members 28. Accordingly, upon movement of either of doors 18A, 18B in a pivoting, rotatable manner about boss members 62, the pivoting, or rotating, motion of one door will cause the other door to pivot or rotate in the opposite direction via the door linkage 28, 30.

A top cover 32 may be provided and is snapped into the front flange 44 of cabinet housing 24 as by snap protrusions 74. The French door arrangement of the doors 18A, 18B within the cabinet housing 24 allows a majority of the doors 18A, 18B, when open, to remain within the cabinet housing 24. This minimizes any protrusion of the open doors 18A, 18B away from the refrigerator door 14. This prevents a user from damaging the refrigerator 10, the chiller compartment 16, or the refrigerator contents should the refrigerator door 14 be closed with doors 18A, 18B left open. The widths of the front wall surfaces 66A, 66B of doors 18A, 18B are different, whereby when doors 18A, 18B are in a closed position, the point at which the right most vertical edge 68 of door 18A meets with the leftmost edge 70 of door 18B will be offset from the center line 72 of the cabinet housing 24. Such an offset allows the user to easily grasp the extended vertical edge 68 when the doors 18A, 18B are open. A handle or other ergonomic surface may be provided on the vertical edge 68. The front wall surfaces 66A, 66B of doors 18A, 18B are generally planar in configuration. The side portion 74A, 74B of each door 18A, 18B is generally curved to mate with the generally curved configuration of the side walls 46, 48 of the cabinet housing 24.

A general description of the present invention as well as a preferred embodiment of the present invention has been set forth above. Those skilled in the art to which the present invention pertains will recognize and be able to practice additional variations in the chiller compartment described which fall within the teachings of this invention. Accordingly, all such modifications and additions are deemed to be within the scope of the present invention which is to be limited only by the claims appended hereto.

What is claimed is:

1. A new chiller compartment for mounting in a refrigerator as part of the refrigerator, the chiller compartment comprising:

a cabinet housing having opposite side walls, a top wall, a bottom wall and a rear wall forming a compartment with an open front;

a pair of doors pivotally mounted to the cabinet housing for movement between a closed position and an open position; and a linkage joining the doors, whereby movement of one door engages the linkage causing the other door to pivot in the opposite direction.

2. The chiller compartment of claim 1 wherein the cabinet housing further includes a bracket for securing the chiller compartment to the inside surface of a refrigerator door.

3. The chiller compartment of claim 1 further comprising a tray inside of the cabinet housing.

4. The chiller compartment of claim 3 wherein the tray includes a vertically upstanding front wall.

5. The chiller compartment of claim 3 wherein the pair of doors are pivotally mounted to the bottom of the tray.

6. The chiller compartment of claim 1 wherein the pair of doors is comprised of a first door and a second door wherein the first door is wider than the second door.

7. The chiller compartment of claim 6 wherein the first door includes a handle.

8. The chiller compartment of claim 1 further comprising a port for receiving cooler air.

9. A refrigerator comprising:

a cabinet having opposite side walls, a top wall, a bottom wall and a rear wall forming a refrigerated chamber with an open front;

a door pivotally mounted to the cabinet for movement between a closed position and an open position, the door having an inside panel and an outside panel;

a chiller compartment mounted on the inside panel of the door, the chiller compartment having a first compartment door and a second compartment door;

a linkage joining the first and second compartment doors wherein the linkage transfers the motion of one compartment door to the other.

10. The refrigerator of claim 9 further comprising a tray in the chiller compartment.

11. The refrigerator of claim 14 wherein the tray includes first pivot ring and a second pivot ring, the first compartment door pivoting about the first pivot ring and the second compartment door pivoting about the second pivot ring.

12. The refrigerator of claim 9 further comprising a port on the chiller compartment for transferring cooler air from the cabinet into the chiller compartment.

13. The refrigerator of claim 8 wherein the first compartment doom and second compartment door are free from contact with the cabinet when the door is in the closed position.

14. A method of accessing a chiller compartment in a refrigerator having a door, the chiller compartment being mainly a part of the refrigerator, the method comprising:

opening the refrigerator door;

grasping a first door of the chiller compartment;

pushing the first door of the chiller compartment away from a closed position causing the first door of the chiller compartment to engage a linkage connecting the first door of the chiller compartment to a second door of the chiller compartment causing both the first door and the second door to open.

* * * * *